US005246106A

United States Patent [19]

Johnson

[11] Patent Number: 5,246,106

[45] Date of Patent: Sep. 21, 1993

[54] COMPARTMENTAL COMMUNION CONTAINER

[76] Inventor: Jimmie L. Johnson, 6267 Belmont Way, West Linn, Oreg. 97068

[21] Appl. No.: 864,494

[22] Filed: Apr. 7, 1992

[51] Int. Cl.[5] ..... A47G 19/22

[52] U.S. Cl. ..... 206/217; 206/19

[58] Field of Search ..... 222/192, 107, 541; 206/19, 217, 534

[56] References Cited

U.S. PATENT DOCUMENTS

| | | | |
|---|---|---|---|
| 2,728,484 | 12/1955 | Farrington | 206/217 X |
| 2,766,796 | 10/1956 | Tupper | 206/217 X |
| 3,083,876 | 4/1963 | Schneider et al. | 222/107 |
| 3,514,029 | 5/1970 | Powell | 206/217 X |
| 3,796,813 | 3/1974 | Kurland | 206/217 |
| 4,040,561 | 8/1977 | Philippon | 206/217 X |
| 4,324,338 | 4/1982 | Beall | 206/217 X |
| 4,684,015 | 8/1987 | Vezirian et al. | 206/19 |
| 4,703,849 | 11/1987 | Vezirian et al. | 206/19 X |
| 4,923,702 | 5/1990 | Powell et al. | 206/19 X |
| 5,009,894 | 4/1991 | Hsiao | 206/534 X |

FOREIGN PATENT DOCUMENTS

| | | | |
|---|---|---|---|
| 1162107 | 9/1958 | France | 206/217 |

*Primary Examiner*—Kevin P. Shaver

*Attorney, Agent, or Firm*—Dellett and Walters

[57] ABSTRACT

A communion dispenser comprises a small open-top cup adapted for containing juice or wine and provided with a substantially flat upper edge or flange. The cup is closed by a two-part lid within which communion bread in the form of an edible wafer is received. The top layer of the lid is first removed to access the wafer and the lower part of the lid is later removed so that a juice or wine within the cup can be taken. The upper and lower layers of the lid preferably comprise folded-over portions of the same piece of paper-foil or paper-plastic material such that a pull-tab or lift-tab on the upper layer is first grasped to peel back the upper layer and reveal the wafer, after which the top layer is pulled farther upwardly, carrying with it the attached lower layer whereby the wine or juice can be taken. The upper and lower layers are heat-sealed to one another and to the edge of the cup in a manner so that they can be conveniently and successively peeled away from the cup.

14 Claims, 3 Drawing Sheets

COMPARTMENTAL COMMUNION CONTAINER

BACKGROUND OF THE INVENTION

The present invention relates to a communion dispenser and particularly to a means and method of providing communion without requiring extensive on-site preparation of the elements.

The ordinance or sacrament of holy communion, which is celebrated on a frequency basis in most Christian churches, involves partaking of the bread followed by the wine or grape juice. These elements often require extensive preparation and special serving plates or containers which are passed to the communicants and then collected. The elements are usually served consecutively inasmuch as they are taken in different parts of the service and it is relatively difficult for the average participant to balance both elements for an extended period of time. Historically, a common cup for the wine was shared by the participants, this being still the practice in many churches.

With small groups or in connection with communion in remote areas, e.g. in the case of battlefield services, the necessary preparations can become difficult and the elements themselves may not be readily available. Therefore, celebration of communion can become infrequency. Even with full facilities, prospective participants may fear contracting communicable diseases especially in areas where sanitation may be a problem.

Moreover, the preparation and serving of the elements sequentially to a large group of people can be quite time-consuming and reduce the time available for other parts of the service. A more efficient plan, so far as the individual is concerned, would be for all communicants to be served and partake of the elements substantially simultaneously.

SUMMARY OF THE INVENTION

In accordance with the means and method of the present invention, a communion dispenser comprises a small, round, tapered cup adapted for containing juice or wine and provided with a substantially flat upper edge or radial flange. The cup is closed by a lid removably secured to the cup's upper edge, the lid comprising two centrally separated layers receiving the communion bread in the form of an edible wafer therebetween. In taking communion, the top layer is first removed by pulling a lift-tab and the wafer is consumed at a designated time by each participant in the service. Then, the second or lower layer of the lid is peeled off to provide access to the juice or wine within the cup. Again, this element is taken by all communicants at one time.

Preferably the upper and lower layers of the lid comprise folded-over portions of the same piece of paper-foil or paper-plastic material wherein the upper and lower layers of the lid are joined at an edge opposite the pull-tab or lift-tab. Once the wafer is consumed and the portion of the service is reached involving the partaking of the wine or juice, the top layer is pulled farther upwardly, carrying with it the attached lower layer which is thereby removed for providing access to the wine or juice.

Communion can be provided for each person in a substantially simultaneous manner, following earlier placement of the above-described communion dispensers along the pews in racks conventionally supplied for receiving used cups. Prepackaging renders the contents completely sanitary and the possibility of spoilage and waste substantially reduced. Less labor is involved at the time of the service and immediately therebefore in preparing and serving the communion elements, and since both elements are supplied simultaneously to the participant, an additional reduction in the time in the service is achieved.

The dispenser has a low unit cost and allows convenient access to communion at remote locations and with regard to small groups or individuals, or wherein the preparations are cumbersome or impossible. While it is envisioned that conventional serving trays are generally unnecessary with the present invention, the communion dispenser in accordance with the present invention can alternatively be substituted for cups currently used in most Protestant churches while eliminating the requirement for separately serving the bread.

It is accordingly an object of the present invention to provide an improved communion dispenser means and method.

It is a further object of the present invention to provide an improved means and method for serving communion in a packaged form which is sanitary and which can be utilized in remote areas without extensive preparation.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 5 is a perspective view illustrating packaging of dispenser means according to the present invention for shipment to remote areas or the like.

DETAILED DESCRIPTION

Figure 1:
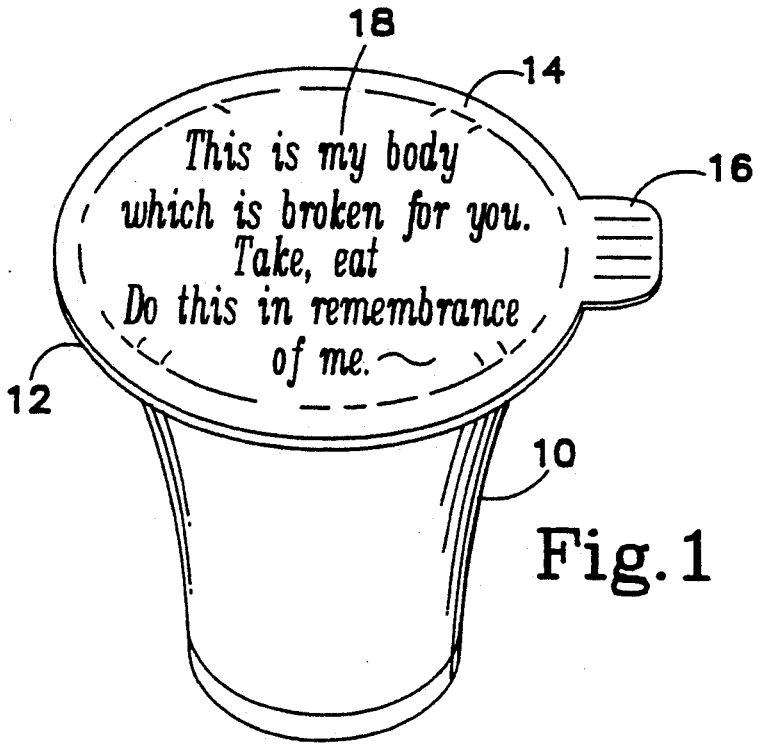
FIG. 1 is a perspective view of a communion dispenser cup employed according to the present invention having its imprinted lid sealed in place.

Referring to the drawings and particularly to FIG. 1, a communion dispenser in accordance with the present invention comprises a small, round, tapered cup 10 adapted for containing juice or wine 26 therewithin. The top of the cup is formed with a flat upper radial edge or radial flange 12 to which a two-part lid 14 is removably secured. The cup 10 is formed of plastic material (e.g. high-impact polystyrene) and is the approximate size of small communion cups conventionally used in Protestant services. The lid 14 is a paper-foil or paper-plastic material as heretofore used with small cups containing dairy products, salad dressing or the like and is heat-sealed to the radial flange 12 in such manner that it can be peeled off by first grasping pull-tab or lift-tab 16 and pulling upwardly.

Rather than being hand-filled, the cup 10 is preferably filled and sealed with packaging machinery of a known type, e.g. a type 200S system or a Trimline system manufactured by Portion Packaging Inc. of Trevose, Pa., as employed for dairy products and the like. Such a system includes a filler-sealer station with a pump-operated nozzle for filling the cup to the desired extent, and the same head used to fill the cup with the wine or juice also seals the lid 14 onto the cup rim. The lid is heat-sealed around the top of radial flange 12 but, because of the materials and method of sealing, is readily removed by grasping tab 16 and peeling off the lid in the manner of a dairy product cup. The top of the lid is imprinted with a suitable scripture verse as shown in FIG. 1.

The lid 14 is comprised of two layers, an upper layer and a lower layer, and the combination is centrally thicker than the usual heat-sealed lid as can be seen in the drawings. The central portion of the lid, at 18, is puckered or distended upwardly, while the lower layer is puckered downwardly to receive a bread/wafer 20, about the size of a quarter, therebetween. The upper layer is distended slightly above the peripheral radial flange 12 of the cup, while the lower layer is distended therebelow. The upper layer 14*a* is peripherally heat-sealed to the lower layer 14*b*, thereby forming a chamber between the layers within which the wafer 20 is initially received.

The lower layer may be depressed as well as heat-sealed onto the cup employing the same filler-sealer head used to supply the juice or wine, or the lids may be initially formed in the distended manner such that the lower layer is concave downwardly while the upper layer is concave upwardly. Alternatively, the distension can simply be provided by the interposition of the wafer on top of lid layer 14*b* wherein the concavity of the lid layers is imparted when the sealing operation takes place.

The lid 14 may be preassembled from the two layers 14*a* and 14*b* and then applied as a unit to the flange 12 of cup 10, or the layers 14*a* and 14*b* can be individually applied to the cup, for example wherein layer 14*b* is first depressed and heat-sealed to the flange 12, after which layer 14*a* is peripherally heat-sealed on top of layer 14*b*. When the lid is first preassembled and applied as a unit to the cup, the two lid layers desirably comprise parts of the same heat-sealable paper-foil or paper-plastic sheet material, joined at one peripheral edge as indicated at 22 in FIG. 4, and folded over with the wafer 20 therebetween. The heat sealing of layers 14*a* and 14*b* together before application to the cup can be mechanized employing the aforementioned apparatus to preseal the two layers peripherally, in the same manner the complete lid is then sealed to the cup's edge flange.

Figure 2:
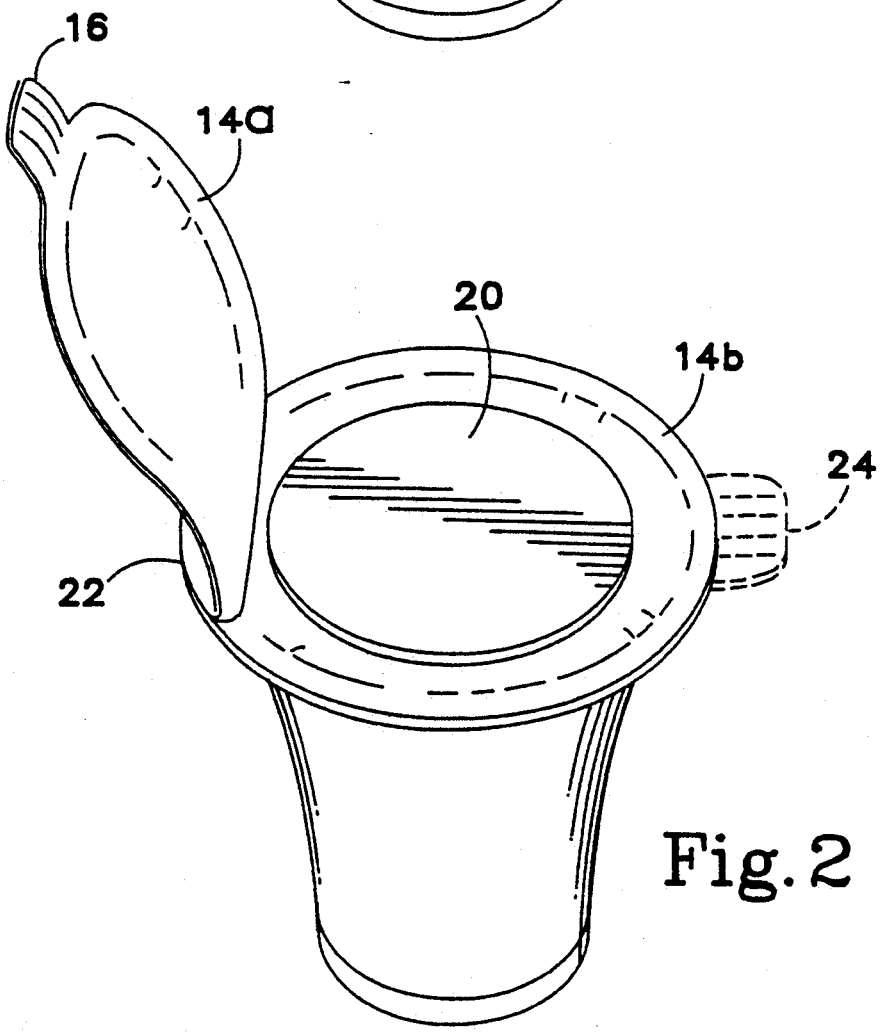
FIG. 2 is a view of the aforementioned dispenser cup having an upper portion or layer of the lid peeled back to reveal a wafer supported by an underlayer or portion of the lid.

In the instance of the embodiment wherein the combination of preassembled lid layers has been secured to the cup, access to the wafer 20 is first provided to the communicant through his separation of the layers as depicted in FIG. 2. The communicant pulls on pull-tab or lift-tab 16 located diametrically opposite the joinder area 22, lifts upwardly, and peels lid layer 14*a* away from the top of the cup to access the wafer 20.

Figure 3:
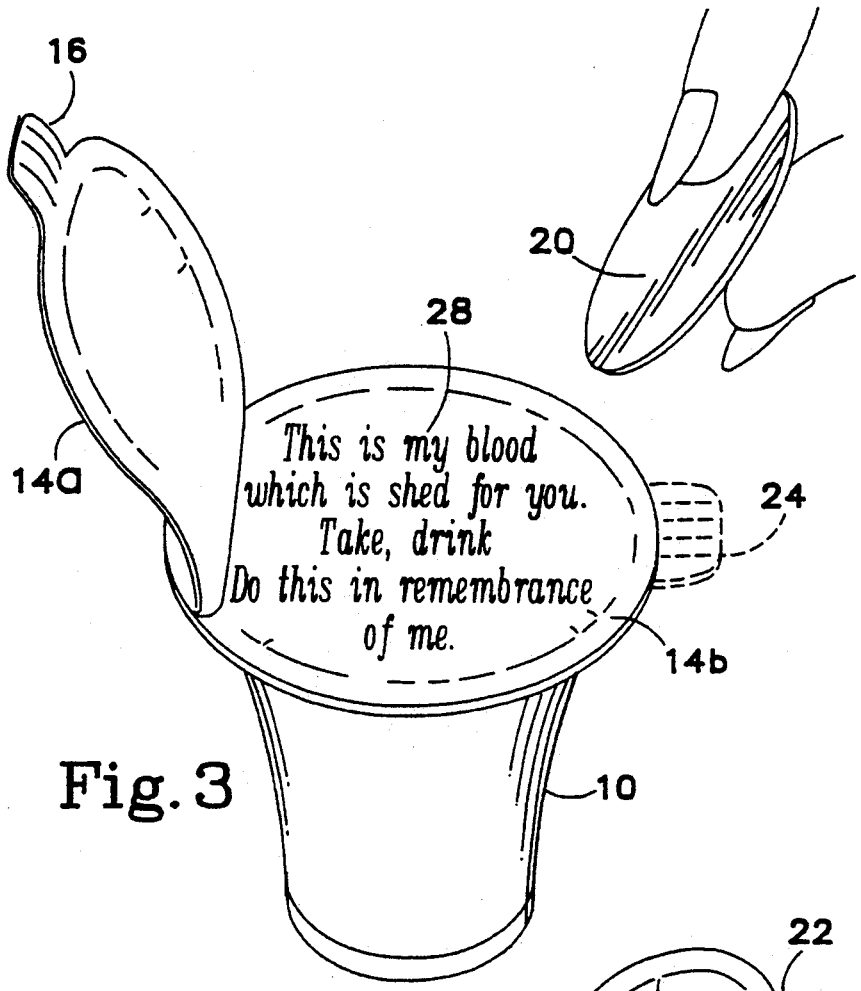
FIG. 3 is a further view of the same cup wherein the wafer has been removed revealing imprinting therebeneath.
Figure 4:
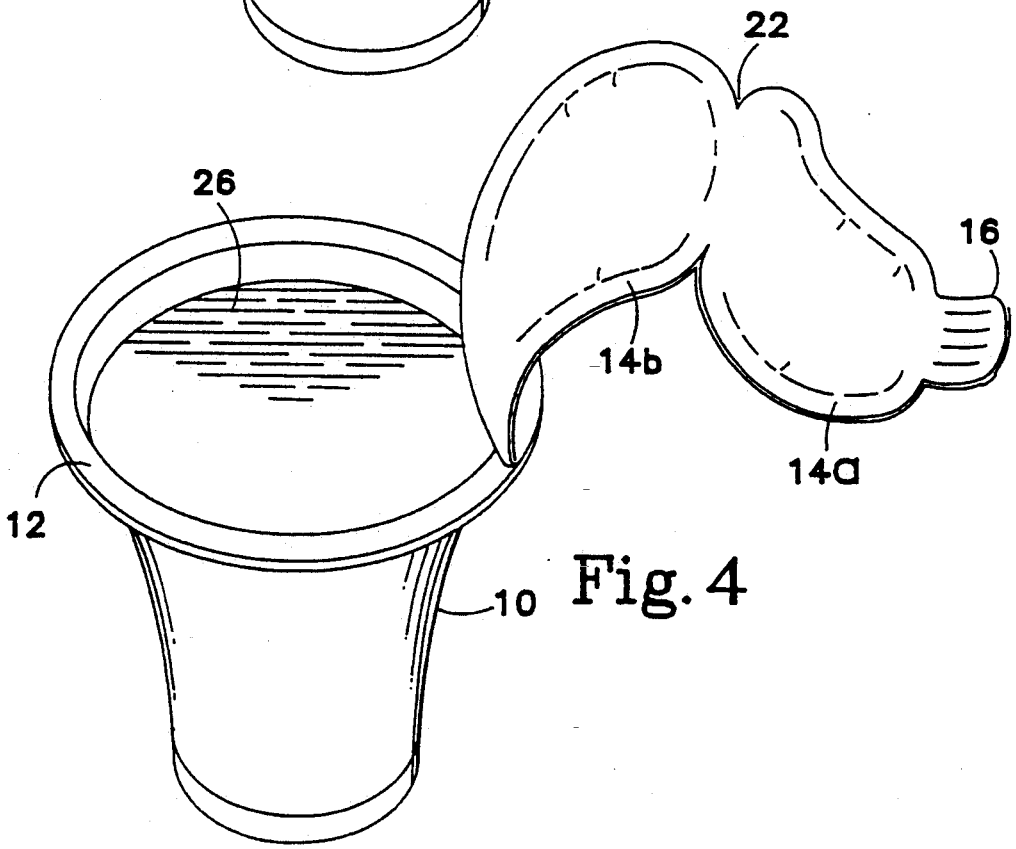
FIG. 4 is a perspective view of the communion dispenser cup wherein the two-part lid has been pulled back to provide access to liquid contained in the cup.

Removal of wafer 20 as indicated in FIG. 3 reveals the upper surface of lid layer 14*b* having a scripture verse imprinted thereon appropriate for the second part of the communion service. After the bread has been taken, and the portion of the service is reached wherein the wine or juice is to be taken, the pull-tab or lift-tab 16 is lifted farther upwardly so as to peel back lower layer 14*b* from flange 12 as illustrated in FIG. 4.

Alternatively, if the lid layers are applied separately to the cup, lower lid layer 14*b* is suitably also provided with a pull-tab or lift-tab indicated in dashed lines at 24 in FIGS. 2 and 3. Tab 24 may be below tab 16 or offset therefrom around the periphery of the cup. After lid layer 14 has been peeled back to provide access to wafer 20 and the same has been taken, pull-tab or lift-tab 24 is employed in the same manner to peel back lower lid layer 14*b* and access the wine or juice.

In either the case where the lid layers are first joined together, or where they are applied separately, the lower lid layer 14*b* is more securely adhered to the flange 12 of the cup than the upper layer 14*a* is adhered to lower layer 14*b*, whereby the upper layer always comes off first for access to wafer 20 instead of the two layers peeling off together. Not only does this accommodate the correct sequence of events, but it is also desirable that the stronger sealing be provided between layer 14*b* and the edge flange 12 of the cup to avoid possible spillage of the wine or juice. Complete sealing of the wafer 20 between layers 14*a* and 14*b* is not quite as critical.

When the layers 14*a* and 14*b* are separately and sequentially applied, such application is accomplished with the same type of filler-sealer apparatus as hereinbefore referenced in a multi-step process. The filler-sealer is first employed to mechanically fill the cup with grape juice or wine to the desired level via the machine's filler head, also used to heat-seal lid layer 14*b* to flange 12 so that layer 14*b* is removably adhered to flange 12. At the same time, this head can be employed to depress or render concave the surface of lid layer 14*b* for later reception of wafer 20, i.e., the head can be formed to protrude slightly downwardly for this purpose. The cup, having layer 14*b* adhered thereto, is then conveyed to a second, wafer-dispensing station where wafer 20 is deposited on lid layer 14*b*. Then, the cup is transferred to a third station similar to the first at which lid layer 14*a* is applied atop the combination and heat-sealed around the peripheral interface between the layers so as to be removably adherent to the layer 14*b*.

Figure 5:
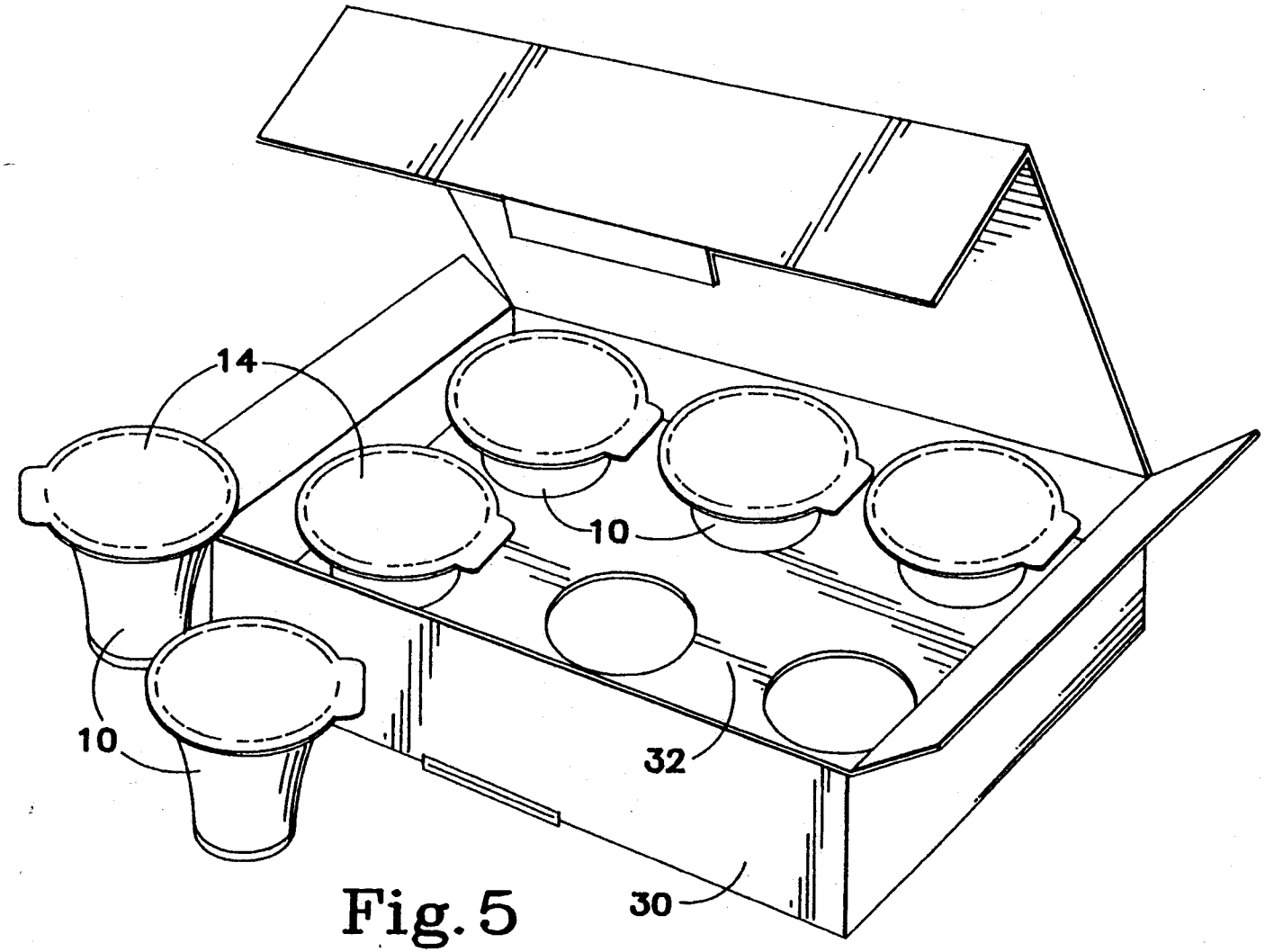

In FIG. 5 a rectangular cardboard container or carton 30 is illustrated which is provided with an apertured horizontal divider 32 for receiving dispenser cups 10 therewithin for shipment. The communion dispenser according to the present invention is thereby easily transported or carried and can be conveniently used for storage or by small groups at remote locations. The container 30 also provides a degree of sanitation for the exterior of the cups and can be used as a serving tray.

The present invention provides a communion dispenser enabling any number of persons to take part in communion without the requirement of extensive preparation or distribution at the time of the service. The dispenser cups according to the present invention can be pre-located in racks before the service commences, or can be conveniently passed via the FIG. 5 container or carton as utilized in place of a communion serving plate. The contents of the cup are maintained in a sanitary condition, lessening the possibility of spoilage and waste and any possible spread of infectious disease. The dispenser according to the present invention has a low unit cost and allows convenient access to communion at remote locations or by small groups or individuals, and where conventional preparations are cumbersome or impossible.

While preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A communion dispenser comprising:

an open-top container adapted to receive a liquid, and a two-part lid for closing said container comprising a lower part and an upper part outwardly adjacent one another but centrally spaced apart for receiving an edible wafer therebetween, wherein said upper part is provided with an edge tab for pulling said upper part away from said lower part and wherein said upper and lower parts are securely joined together at the edge thereof on the opposite side of said container from said edge tab, wherein said upper part and said lower part of said lid comprise folded over portions of the same material, wherein said lid is adhered to the top of said container around an edge thereof and the upper part is initially removable away from the lower part other than where said upper and lower parts are joined together to provide access to said wafer, and wherein the lower part of said lid is removable to provide access to said liquid.

2. The communion dispenser according to claim 1 wherein said lid comprises heat-sealable material.

3. The communion dispenser according to claim 1 wherein said container is formed of plastic.

4. A communion dispenser comprising:

a round tapered cup adapted to contain a liquid and provided with a substantially flat upper edge, and a two-part lid adapted to be secured to said cup including a pair of layers peripherally adjacent and centrally separated for receiving an edible wafer therebetween, wherein the lower of said two layers is removably adhered to the upper edge of said cup and wherein the upper of said two layers is removably and less securely adhered to the lower layer so that the user can first remove said upper layer for access to said wafer followed by removal of said lower layer for access to said liquid wherein the peripheries of said upper and lower layers are thus adhered to one another along the edge of said cup so as not to inhibit initial upraising of said upper layer from said lower layer while enabling subsequent upraising of said lower layer.

5. The communion dispenser according to claim 4 wherein said lid is formed of heat-sealable material, said lower of said two layers being removably heat sealed to the upper edge of said cup and the upper edge of said two layers being removably heat sealed to said lower layer.

6. The communion dispenser according to claim 4 wherein said cup is formed of plastic.

7. The communion dispenser according to claim 4 wherein said upper layer is provided with an edge tab extending radially outwardly from said cup for pulling said upper layer away from said lower layer.

8. The communion dispenser according to claim 4 wherein said lower layer is provided with an edge tab extending radially outwardly from said cup for pulling said lower layer away from said cup.

9. The communion dispenser according to claim 4 wherein each of said layers is imprinted on the top thereof.

10. The communion dispenser according to claim 4 wherein said upper layer comprises a folded-over extension of said bottom layer which is adapted to be unfolded to provide access to said wafer.

11. The communion dispenser according to claim 4 wherein said upper and lower layers are joined along the edge of said cup at adjacent aligned portions of said layers so as not to inhibit upraising of said upper layer from said lower layer while enabling upraising of said lower layer as joined to said upper layer by continued upward movement of said upper layer substantially after the initial lifting of said upper layer.

12. The communion dispenser according to claim 11 wherein said upper layer is provided with a radially outwardly extending edge tab located substantially across said cup from the location where said upper and lower layers are joined.

13. A method of providing a communion dispenser comprising:

at least partially filling a round open-top container with a liquid, removably adhering a first lid layer to the peripheral top of said container in a manner for substantially sealing said liquid within said container but whereby said first lid layer can be peeled away from the top of said container for providing access to said liquid, positioning an edible wafer on top of said first lid layer, removably adhering a second lid layer peripherally to the first lid layer where the first lid layer adjoins the top of said cup to provide a chamber for receiving said wafer whereby said second lid layer can be peeled away for access to said wafer, and securing a portion of said second lid layer to said first lid layer, such that said first and second layers are less likely to separate at the secured portion when said second lid layer is peeled away than said first layer is likely to peel away from the top of said container.

14. A method of providing a communion dispenser comprising:

at least partially filling a round open container with a liquid, adhering a first layer of a lid for said container to a second layer of a lid for said container toward the radially outer portion thereof such that a majority of the perimeters of said first and second layers are removably adhered to one another and including an edible wafer centrally between said layers whereby the wafer resides in a chamber between said layers as adhered, substantially non-removably adhering a portion of said first and second layers to one another, and removably adhering the combination of said layers substantially around the periphery thereof to the periphery of the open top of said container.

* * * * *

UNITED STATES PATENT AND TRADEMARK OFFICE

CERTIFICATE OF CORRECTION

PATENT NO. : 5,246,106

DATED : September 21, 1993

INVENTOR(S) : Jimmie L. Johnson

It is certified that error appears in the above-identified patent and that said Letters Patent is hereby corrected as shown below:

On the title page, item [54] and col. 1, line 2, in the title "COMPARTMENTAL COMMUNION CONTAINER" should read --COMPARTMENTED COMMUNION CONTAINER--.

Signed and Sealed this

Seventeenth Day of May, 1994

*Attest:*

*Attesting Officer*

BRUCE LEHMAN

*Commissioner of Patents and Trademarks*